US005882441A

United States Patent [19]

Davitz

[11] Patent Number: 5,882,441

[45] Date of Patent: Mar. 16, 1999

[54] SILVER COLORED ALLOY WITH LOW PERCENTAGE COPPER

[76] Inventor: Daniel Davitz, 4103 Florence Way, Glenview, Ill. 60025

[21] Appl. No.: 905,244

[22] Filed: Aug. 1, 1997

Related U.S. Application Data

[63] Continuation-in-part of Ser. No. 752,208, Nov. 19, 1996.

[51] Int. Cl.[6] ..... C22C 5/00

[52] U.S. Cl. ..... 148/430; 420/501; 420/502; 420/504; 420/506; 148/431

[58] Field of Search ..... 420/501, 502, 420/504, 506; 148/430, 431

[56] References Cited

U.S. PATENT DOCUMENTS 4,944,985 7/1990 Alexander et al. ..... 428/570
4,973,446 11/1990 Bernhard et al. ..... 420/504
5,037,708 8/1991 Davitz ..... 428/673

FOREIGN PATENT DOCUMENTS 59-038346 7/1982 Japan .
62-243725 9/1986 Japan .

*Primary Examiner*—Patrick Ryan
*Assistant Examiner*—M. Alexandra Elve
*Attorney, Agent, or Firm*—Michael, Best & Friedrich

[57] ABSTRACT

A silver colored alloy, highly tarnish resistant, corrosion resistant and brittleness free is provided. The alloy includes 90% to 94% by weight silver, 3.50% to 7.35% by weight zinc, 1% to 3% by weight copper, and 0.1% to 2.5% by weight silicon. The alloy is suitable for rings, earrings, bangles and other jewelry.

4 Claims, No Drawings

SILVER COLORED ALLOY WITH LOW PERCENTAGE COPPER

This application is a continuation in part of Ser. No. 08/752,208 filed Nov. 9, 1996.

BACKGROUND OF THE INVENTION

FIELD OF THE INVENTION

The invention relates generally to silver alloys, and specifically to sterling silver alloys having improved tarnish resistance, and casting qualities. Preferable this alloy must be moldable and castable with low surface tension to conform to intricate molds. In addition, the alloy should provide a material which does not easily tarnish.

PRIOR ART

Sterling silver jewelry and utensils are valued because of their intrinsic worth and the silver color of the metal. However, problems occur due to the tendency of sterling silver to tarnish easily and the fact that sterling silver is usually brittle after casting. Sterling silver is 92.5% silver and 7.5% copper. As a result, many attempts have been made to improve the tarnish resistance and corrosion resistance of sterling silver and to improve the casting qualities of the alloy.

For example, an object called precium was produced which comprises 74% silver, 25% PD and 1% IN. Another alloy previously sold is 66% silver, 23% PD, 1% IN. However these alloys have been found to be too expensive for substantial commercial use. Applicant has invented a sterling silver alloy which is the subject of a U.S. Pat. No. 5,037,708. However, a lower cost silver alloy is desirable.

U.S. Pat. No. 4,944,985 to Alexander, discloses a silver alloy for plating that uses silica as an extender but not pure metal silicate as in the present invention or for improved casting properties. Rather, silicate in combination with other materials is disclosed. Alexander et al further discloses that ductility and smooth surface finish are desirable, but does not describe how to prevent brittleness. Further, Alexander et al describes the use of silicates as extenders, which are defined as making casting easier and increasing the volume of the alloy using low cost materials. The present invention teaches an alloy which increases the fluidity over alloys of the prior art.

Japanese Patent No. 59038-346A teaches an alloy that has Zinc and Nickel. However, the amount of Copper in the present invention is less than that of the Japanese reference and the reference further teaches Indium in a concentration less than the present invention, and use of Bismuth where Bismuth is not used in the present invention. However these alloys have been found to be too expensive for substantial commercial use.

Japanese Patent No. 62-243725 teaches a jewelry alloy with concentrations of Silver, Zinc, Indium and Copper with ranges that overlap in those of the present invention. However, the reference does not teach the use of silicates in the prior alloys nor the physical properties of casting and melting temperatures taught by the prior art nor the intended use for jewelry.

SUMMARY OF THE INVENTION

Accordingly, an object of the present invention is to provide a more corrosion resistance and tarnish resistant silver alloy with better working properties than regular sterling silver and to make a harder sterling silver alloy.

An additional object of the present invention is a silver alloy having chemical and physical properties suitable for use in jewelry.

An additional object of the present invention is to provide a silver color alloy, that will provide better tarnish resistance, corrosion resistance and better working properties and still have a low cost alloy.

Other objects of the present invention and advantages accruing therefrom will be apparent to one skilled in the art in the following description. All percentages referred to are percent by weight on the total weight of the material or mixture.

SUMMARY OF THE INVENTION

In accordance with this invention, an alloy is provided which contains silver, zinc, and a low percentage of silicate and may contain a small amount of nickel. This alloys polishes and works like sterling silver as well as having the appearance of sterling silver. In a 5% chlorine atmosphere the invention is found to be superior to sterling silver containing 92.5% by weight silver and 7.5% by weight copper and in fact is showed no discolorization while the sterling silver turned black. The same thing occurred when this invention was placed in a sulfur gas atmosphere for 24 hours; the invention was still bright and the sterling silver tarnished. A more corrosion resistant and tarnish resistant alloy then sterling silver is then provided by removing a portion of the copper from sterling silver and replacing the copper with zinc and silicate.

An additional object of this invention is the production of a silver alloy, using zinc and a small amount of copper for hardness that will reduce tarnishing, increase corrosion resistance, and provide better working properties by reducing brittleness while still producing a low cost alloy.

Other objects of the present invention and advantages accruing therefrom will be apparent to one who is skilled in the art in the following description. All percentages referred to are percent by weight based on the total weight of the material or mixture.

DETAILED DESCRIPTION OF THE PREFERRED EMBODIMENT

In accordance with the present invention, a silver colored metal alloy is disclosed which is more tarnish resistant, corrosion resistant and with better working properties and consisting of the following ingredients: 90% to 94% by weight silver, 0.1% to 0.25% by weight silicate, 7.35% to 3.5 by weight zinc, and 1% to 3.5% by weight copper.

To be considered in the sterling family we must use 92.5% by weight silver and usually make up the balance to 100% with copper. But in this invention the copper is reduced to enhance the tarnish resistance and the corrosion resistance of the alloy, and is replaced with zinc. We found that this gives us a more stable color alloy than sterling silver, and eliminates the brittleness of sterling silver after casting. To be considered like sterling silver the ratio of silver is 92.5% by weight, 4.5% by weight zinc, 2.9% by weight copper, and approximately 0.1% by weight silicate. Zinc enhances color and helps in the tarnish and corrosion resistance, silicate makes smoother castings by being a deoxidizer and making the molten metal more fluid. The acceptable ranges are 90–94% silver, 3.5% to 7.35% zinc 1 to 3% copper and 0.1 to 0.25% silicate.

The specific gravity of the alloy is 8.85 GR/CC plus or minus 0.5 GMS/CC. Other physical proprieties are:

Low hardness 85 Brinell heat treated in furnace 850 degrees F. and quenched

High hardness 130 Brinell hardness heat treated in furnace 850 degrees F. and Bench cooled Elongation 15% to 28%

Specifically, the preferred alloy formula in accordance with the invention is:

Silver 92.5% by weight
Zinc 4.5% by weight
Copper 2.9% by weight
Silicate 0.1% by weight While this invention has been described with reference to a preferred content and formula, it will be understood by those skilled in the art that various changes may be made and equivalents substituted for elements described herein without departing from the scope of the invention. In addition, many modifications may be made to adapt to a particular situation or material to the teachings of the invention without departing from the scope of the invention. Therefore, it is intended that the invention cannot be limited to the particular embodiment disclosed as the best mode contemplated for caring out this invention, but that the invention will include all embattlements falling within scope if the appended claims.

I claim as my invention:

1. A silver colored highly tarnish resistant, corrosion resistant and non-brittle free alloy consisting essentially of:

90% to 94% by weight silver;

3.75% to 7.35% by weight zinc;

1% to 3% by weight copper; and 0.1% to 0.25% by weight silicon.

2. The alloy of claim 1, wherein the casting temperature is 1860 degrees F. plus or minus 50 degrees.

3. The alloy of claim 1, wherein the melting temperature is 1750 degrees F. plus or minus 50 degrees.

4. A jewelry alloy suitable for rings, earings and bangles, consisting essentially of 92.5% by weight silver, 4.5% by weight zinc, 2.9% by weight copper, and 0.1% by weight silicon.

* * * * *